US007752685B2

(12) United States Patent
Tudor

(10) Patent No.: US 7,752,685 B2
(45) Date of Patent: Jul. 13, 2010

(54) FOLDABLE SPA COVER DEVICE

(76) Inventor: E. Jess Tudor, 3100 Merriman Rd., Medford, OR (US) 97501

( * ) Notice: Subject to any disclaimer, the term of this patent is extended or adjusted under 35 U.S.C. 154(b) by 0 days.

(21) Appl. No.: 11/280,436

(22) Filed: Nov. 15, 2005

(65) Prior Publication Data

US 2007/0107118 A1 May 17, 2007

(51) Int. Cl.
*E04H 4/00* (2006.01)

(52) U.S. Cl. ..... 4/498

(58) Field of Classification Search ..... 4/498–500, 4/503

See application file for complete search history.

(56) References Cited

U.S. PATENT DOCUMENTS

| | | | | |
|---|---|---|---|---|
| 1,408,387 | A * | 2/1922 | Nichols et al. | 220/826 |
| 3,209,373 | A * | 10/1965 | Meredith et al. | 4/494 |
| 4,587,678 | A * | 5/1986 | Love et al. | 4/667 |
| 5,048,153 | A | 9/1991 | Wall et al. | |
| 5,086,525 | A | 2/1992 | Christopher | |
| 5,131,102 | A | 7/1992 | Salley et al. | |
| 5,634,218 | A | 6/1997 | Ouelette | |
| 5,689,841 | A * | 11/1997 | Black et al. | 4/498 |
| 5,974,599 | A | 11/1999 | Tudor | |
| 6,000,071 | A * | 12/1999 | Fettes | 4/498 |
| 6,032,305 | A * | 3/2000 | Tedrick | 4/498 |
| 6,158,063 | A | 12/2000 | Tudor | |
| 6,634,036 | B2 | 10/2003 | Tudor | |
| 6,795,984 | B1 * | 9/2004 | Brady | 4/498 |
| 6,938,281 | B1 | 9/2005 | Tudor | |
| 7,155,756 | B1 * | 1/2007 | Helder | 4/498 |
| 2004/0143895 | A1 * | 7/2004 | Loyd et al. | 4/498 |

FOREIGN PATENT DOCUMENTS

JP 07275143 A * 10/1995

OTHER PUBLICATIONS

Pool Cover Specialists National, Inc. "EZ Top, Automatic Spa Cover and Entertainment Bar" (Web Page, Circa 2007).

* cited by examiner

*Primary Examiner*—Huyen Le
(74) *Attorney, Agent, or Firm*—Richard Esty Peterson

(57) ABSTRACT

An improved automated spa cover lifting device and thermally efficient, foldable spa cover, the lifting device having a motorized expandable and retractable strut attachable to a spa housing and to at least one of two pivotal side arms that connect or support a folded spa cover to the spa housing during displacement with the preferred spa cover having a bevel at the fold to improve the thermal efficiency of the cover.

9 Claims, 4 Drawing Sheets

FOLDABLE SPA COVER DEVICE

BACKGROUND OF THE INVENTION

This invention relates to improvements in spa covers with lifting devices and, in particular, to improvements in the types of spa covers and lifting devices disclosed in my U.S. Pat. Nos. 5,974,599, issued Nov. 2, 1999; 6,185,063, issued Dec. 12, 2000; 6,634,036, issued Oct. 21, 2003; and, 6,938,281, issued Sep. 6, 2005.

The foldable spa cover and lifting device of this invention automates the lifting unit of operation and improves the thermal efficiency of the preferred assembly during use.

Spa covers come in a variety of different configurations adapted to conform to the open top of a spa. Typically, a heated spa has a spa structure or housing that supports an insulated spa cover to retain the heat of the spa water during periods of non-use. A conventional spa cover comprises a thick, insulated foam pad covered with a protective, impervious casing. Because the spa cover can become unwieldy, the modern spa cover is typically foldable along a center fold to facilitate removal and replacement. This folding feature of the modern spa cover was used to advantage in the spa cover lifting devices described in the referenced U.S. Pat. Nos. 5,974,599 and 6,158,063. A spa cover lifting device eases the burden of removing and replacing the spa cover by use of a pivoting lifting frame that is connected to the spa structure.

In embodiments prior to the U.S. Pat. No. 6,634,036, the lifting devices had a cross member that spanned the spa cover and took advantage of the fold in the cover to engage the cover when lifting the folded cover to a convenient vertical storage position or returning the folded cover from the storage position to the top of the spa. In such a system the lifting frame had two arms that were pivotally mounted to the spa structure and supported a cross member over the top of the spa cover. Although not fixed to the spa cover, the lifting frame is effectively connected to the cover when the cover is folded over the cross member of the frame. During periods of non-use, when the cover is unfolded and lying flat on the top of the spa structure, the cross member rests on the top of the cover and detracts from the appearance of the cover. In certain instances the weight of the cross member and lifting arms can deform the top of the cover. Additionally, when the spa cover lifting frame is sold as a kit, the frame must be provided with adjustment mechanisms in order to adapt the frame to a particular cover and spa structure.

The integrated spa cover and lifting device described in U.S. Pat. No. 6,634,036 enables the spa cover to be engaged at the sides thereby eliminating the unattractive and potentially damaging cross member. Additionally, with a part of the lifting mechanism incorporated into the cover, an adjustable cross member is not required and the frame parts are reduced in number and cost. These and other features of the improved spa cover and lift unit will become apparent from the following summary and detailed description of the preferred embodiments.

SUMMARY OF THE INVENTION

The folded spa cover and lift unit of this invention incorporates improvements in spa cover designs for thermal efficiencies with lifting aids for facilitating the lifting process in conveniently removing and replacing an insulated covering for a heated spa.

The term "spa" is used to generally describe a hot tub or other bath facility with a whirlpool that is customarily used at home or in an apartment or condominium complex. In general, the volume of water in the spa is maintained heated for an extended period of time and it is therefore desirable to cover the spa with a cover that provides thermal insulation for the heated water to reduce the cost of reheating the water to the desired temperature. In addition, the insulated spa cover provides protection of the contained water from contamination with debris.

The lifting mechanism includes a frame apparatus that is in part pivotally connected to the spa structure or housing of the spa, and in part connectable to the foldable spa cover.

A conventional spa is typically constructed with an inner water container with external water heating and circulating systems to circulate heated water in the container. The inner container and circulating conduits are typically housed in a cabinet or on a support pedestal which provides an exterior surface for attaching the lifting apparatus. Details of the internal construction of the spa are omitted in this description as being unnecessary to the structure and operation of the combination spa cover and lift unit of this invention.

The spa cover used in this invention is a folding type that includes a thick, padded cover piece that is essentially provided in two half segments connected together by a hinge seam for folding to facilitate the removal, replacement and storage of the cover. At least one of the segments of the folding cover includes an internal cross support to prevent the cover from sagging when spanning a spa structure. In this invention the supporting internal cross member in at least one of the cover segments is utilized for anchoring an interconnection mechanism for engaging the distal ends of the arm members of the frame apparatus. The lifting device not only assists in removal and replacement of the cover, but is designed to conveniently store the folded cover in a suspended vertical position at the side of the spa to preserve the form of the cover piece and maintain the cover in an elevated position above the ground. The lifting device thereby minimizes the handling of the spa cover during use of the spa which avoids damage and greatly extends the useful life of the cover.

The half segments of the foldable spa cover have typically vertical butted edges at the fold as described in the referenced U.S. Pat. No. 6,634,036, eliminating the necessity of providing additional outer covering material at the hinge seam, greatly improving the thermal efficiency of the unfolded spa cover during periods of non-use of the spa. However, the vertical butted edges of the thickly padded cover pieces still provided a pathway for heat to escape.

A modification to the butting edges of the two cover pieces, by providing the edges with an angled or chamfered edge, allows one cover piece to seat at its hinged edge on the other and, with the modest weight of gravity to improve the seal between the cover pieces.

To facilitate the lifting process, at least one of the opposite side arm members of the frame apparatus has a motorized assist mechanism. In this manner, operation of a low voltage motor lifts and returns a folded spa cover on the push of a button.

These and other advantages will become apparent upon a consideration of the detailed description that follows.

DETAILED DESCRIPTION OF THE PREFERRED EMBODIMENTS

Figure 1:
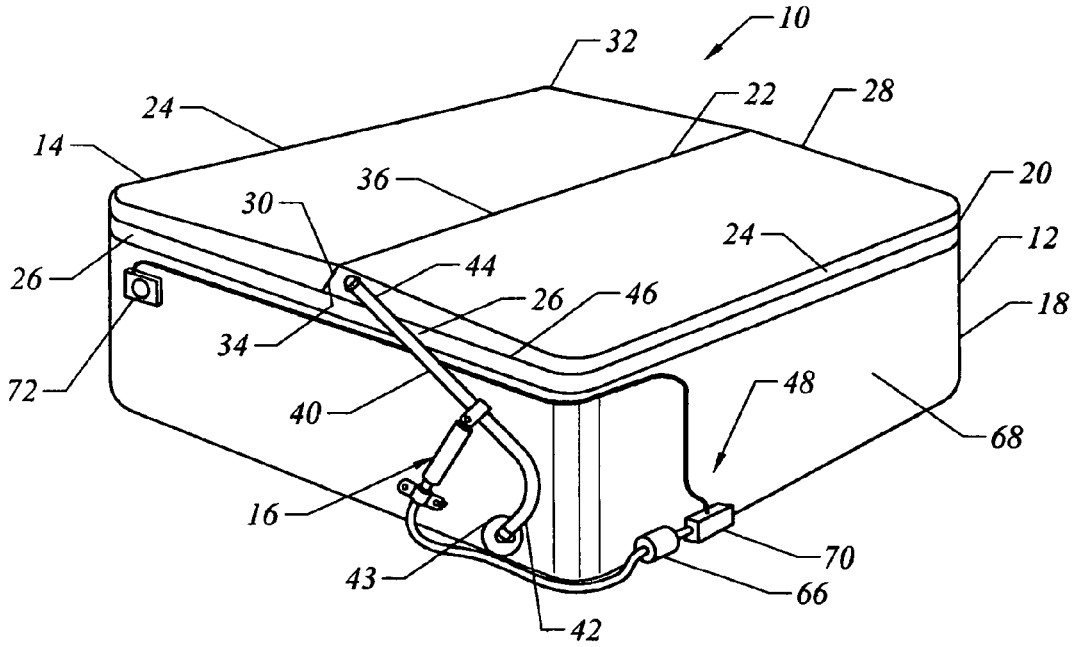
FIG. 1 is a perspective view of the automated spa cover lift device and preferred thermal cover installed on a typical spa.

The foldable spa cover and lifting device of this invention is designated generally by the reference numeral 10 and is shown installed on a typical spa 12. The combined spa cover and lifting device 10 includes in its preferred embodiment an improved spa cover 14 and an automated lift system 16.

The spa 12 includes a generally rectangular housing structure 18 forming an outer cabinet which provides a convenient mounting surface for the automated lift system 16 and has a perimeter top 20 on which the spa cover is seated.

The foldable spa cover 14 in FIG. 1 is shown in its unfolded position covering the perimeter top 20 of the spa 12. The cover is fabricated of a thick insulating material, covered with a weather resistant and water impervious sheeting material. To minimize the weight of the spa cover 14, the thickness of the cover tapers from the center fold 22 to the outer edges 24. The spa cover 14 preferably includes a perimeter skirt 26 along the perimeter top 20 to improve the insulating seal of the spa cover 14 when seated on the spa 12.

Figure 3:
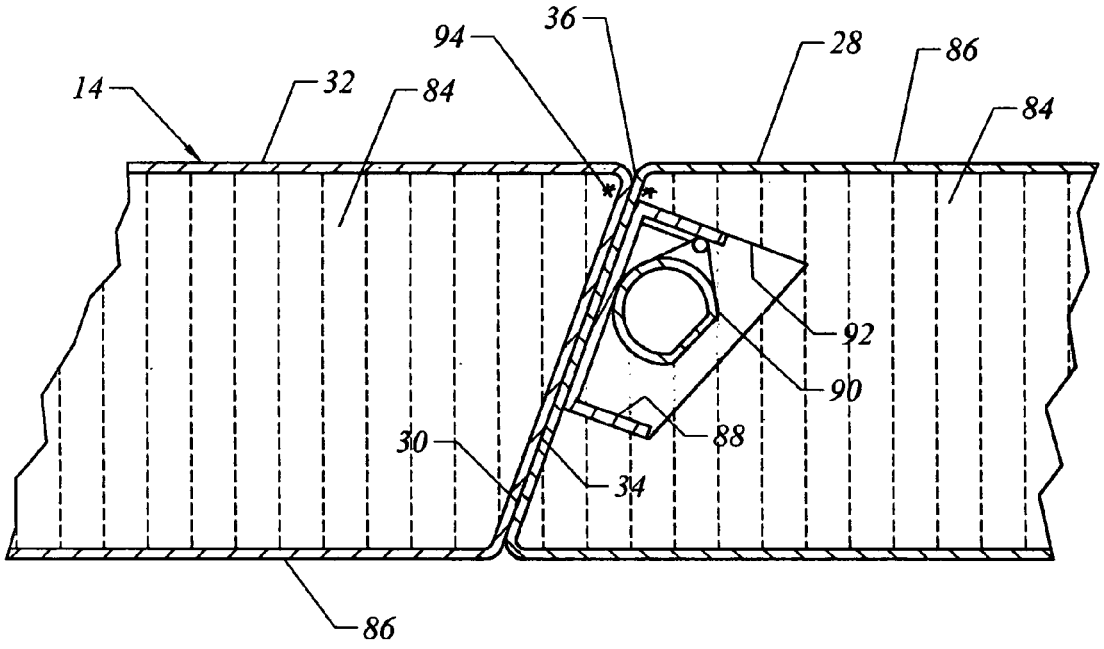
FIG. 3 is a cross-sectional view of the hinge portion of the preferred foldable spa cover.

The improved foldable spa cover 14 has a first half-cover segment 28 with an inclined center edge 30 and a second half-cover segment 32 with a complimentary inclined center edge 34 that abuts the center edge 30 of the first half-cover segment 28 to form the distinct bevel 36 at the center fold 22 as shown in greater detail in FIG. 3.

The automated spa cover lift system 16 includes a frame apparatus 26 having side arms 40 (one shown) located on two opposite sides of the spa 12. The side arms 40 preferably have first ends 42 engaged with pivot brackets 43 mounted on opposite sides of the spa and distal ends 44 that preferably engage the opposite side edges 46 of the first half-cover segment 28 of the spa cover 14. It is to be understood that the automated spa cover lift system 16 can be adapted to a frame apparatus of a different configuration with variations in the pivotal mounting mechanism.

Figure 2:
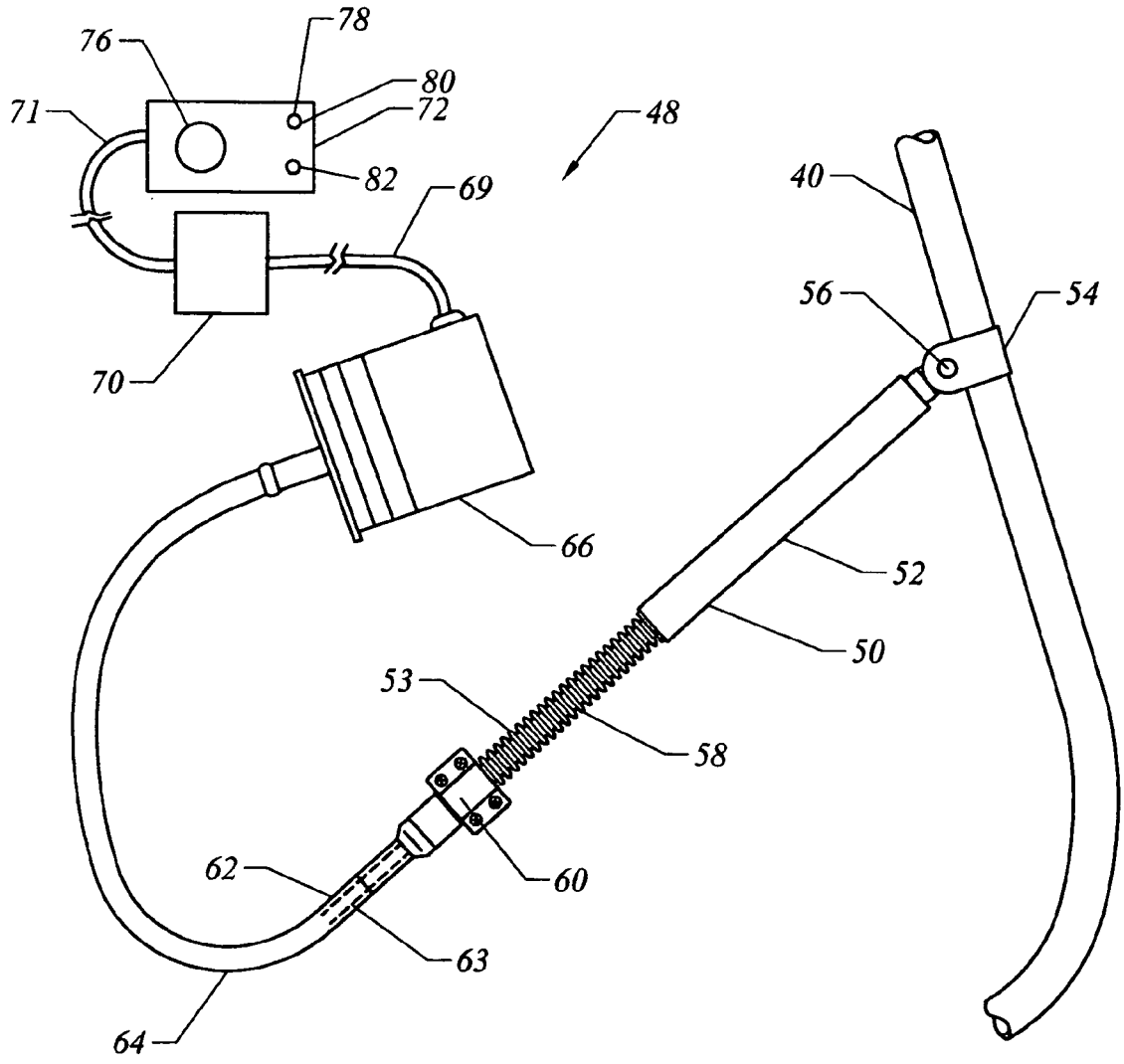
FIG. 2 is an enlarged perspective view of the automated lift system connected to a side arm shown in part.

The component actuating assembly 48 is shown in FIG. 2 and can be provided as a kit and incorporated onto existing spa cover lift devices having a frame apparatus 26 with pivotal lift arms on opposite sides of the spa 12. As shown in FIG. 2, the component actuator assembly 48 includes an expandable and retractable strut 50. The strut 50 has one end with a screw casing 52 and a yoke bracket 54 connected to one side arm 40 by a pivot bolt 56. The strut 50 has an opposite end with a screw shaft 58 threadably engaging the screw casing 52 with an end 53 rotationally engaged and axially restrained by a swivel post bracket 60. The swivel post bracket 60 and yoke bracket 54 allow the strut 50 to articulate with reference to the side arm 40 and spa housing structure 18 during expansion and contraction of the strut 50 and pivotal displacement of the side arm 40.

As shown in FIGS. 1 and 2, the threaded shaft 58 is attached to a flex cable 62 that has a rotatable internal flexible shaft 63 (shown in part on dotted line) in an outer protective casing 64. The flex cable 62 is connected at its opposite end to the shaft (not visible) of a low voltage drive motor 66. The flex cable 62 is of sufficient length to allow the drive motor 66 to be mounted to what is typically the back side 68 of the spa cabinet 18 as shown in FIG. 1, or at some other convenient out-of-the-way location. In the installation of FIG. 1, the drive motor is electrically coupled by cord 69 to a power source 70, such as a 12 Volt D.C. battery pack mounted next to the motor, and by cord 71 to a controller 72. The controller 72 has a control panel 74 with an on/off switch 76 and signalling elements 78, such as indicator lights 80, 82.

It is understood that the other features can be added to the controller to enhance utility. The indicator lights 80, 82 may, for example, signal operation of the lift system and low battery or some other event. Also, the power source 70 may be a remote source and connected by a low voltage power line to the controller 72 which in turn is connected to the drive motor 66. Other arrangements will be apparent to those of ordinary skill in the art when locating controls including any necessary positioning sensors for de-limiting motorized displacements of the frame apparatus during operation. Positioning the power source and drive motor low on the back side 60 of the spa locates the components in an out-of-way storage location under the folded cover. This location is advantageous in certain situations.

Referring to FIG. 3, an enlarged partial cross-sectional view of the hinge section of the preferred spa cover 14 is shown. As previously noted, the spa cover has interior lightweight foam blanks 84 encased in a water-impervious stitched casing 86. Embedded in at least one of the foam blanks 84 is a C-channel 88 used to structurally re-inforce the spa. In the preferred embodiment, a socket sleeve 90 with limited pivot is attached to the C-channel 88 in a cavity 92 on each of the opposite sides of the first half-cover segment 28. The socket sleeves 90 are engaged by the distal ends 44 of the side arms 40 to couple the spa cover 14 to the frame apparatus for raising and lowering a folded cover with the aid of the motorized actuating assembly 48. It is to be understood that other means of coupling the spa cover with a frame apparatus may be utilized.

As shown, the C-channel 88 is preferably oriented flush with the inclined center edge 30 of the cover segment 28 where the incline forms an obtuse angle at the top. The incline center edge 34 of the other half-cover segment 32 is complimentary to the center edge 30, such that the narrowed passage at the bevel 36 is inclined. The half-cover segments 28 and 32 are interconnected by a double stitching 94 through the casings 86 at the top of the center edges 30 and 34. In this manner, when the half-cover segment 32 is folded over half-cover segment 28, the segments 30 and 32 remain coupled. When folded flat, as shown in FIG. 3, the weight of the cover segment 32 on the cover segment 28 aids in sealing the passage at the bevel 36, minimizing thermal leakage.

Figure 4:
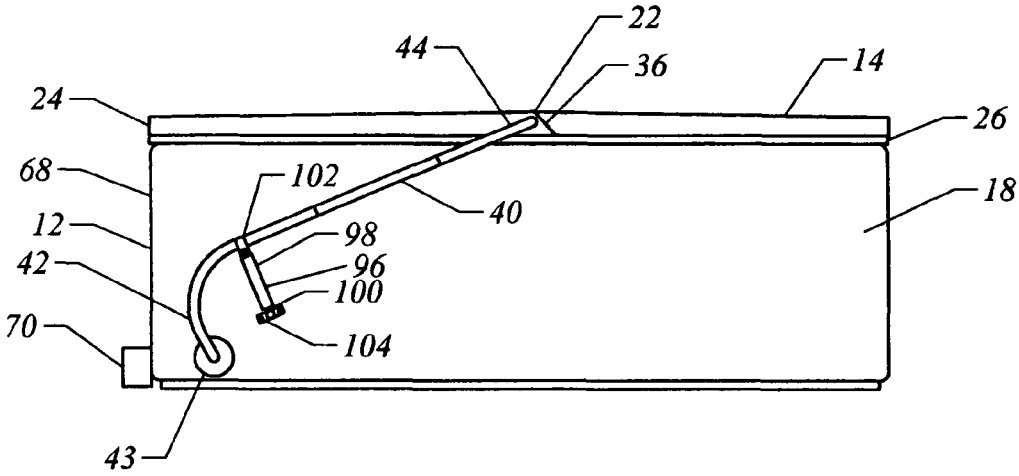
FIG. 4 is a side elevational view of the opposite side of the spa of FIG. 1 showing a spring-loaded strut assembly.

As shown in FIG. 4, the side of the spa 12, opposite the side having the component actuating assembly, need not include a motorized system when using the structurally reinforced connection system described with reference to FIG. 3. In FIG. 4, an optional strut assembly 96 includes an outer spring casing 98 that houses a compression spring (not visible) compressed by telescoping shaft plunger 100 to provide a spring assist to aid in lifting when the motorized component actuating assembly 48 is operated. The strut assembly 96 has a yoke bracket 102 connecting the strut assembly 96 to the lifting arm 40 and a swivel post bracket 104 for mounting the strut assembly to the housing structure. The strut assembly expands with the assist of the spring when the motorized component actuator assembly is activated and the lifting action begins.

When utilizing a component actuating assembly, having a drive motor 66 and motorized struts 50 on each side of the spg, a singly motion 66 with two separate flex cables 62 connected to the struts 50 is preferred to operate the side arms 40.

Figure 5:
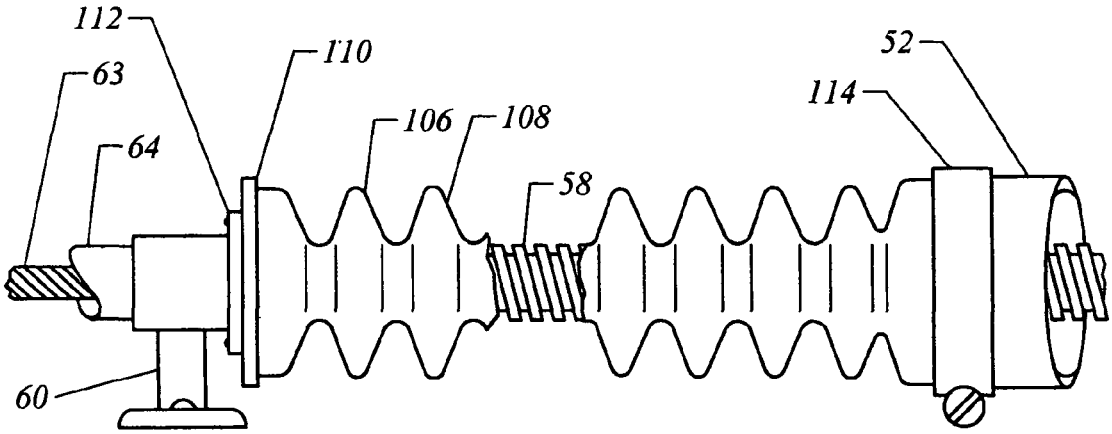
FIG. 5 is a side elevational view of the automated spa cover lift device at the initiation of the lift process.

As an added safety feature, the motorized, expandable and retractable strut 50 of FIG. 2 includes a protective boot 106 as shown in FIG. 5. The boot 106 has a rubber-like accordion casing 108 with an integral end plate 110 that is attached to an added flange 112 on the swivel post bracket 60. The casing 108 is broken away to show the inner threaded shaft 58 that is attached to the flexible shaft 63 in the outer casing 64 of the flex cable.

The other end of the accordion casing 108 is attached to the screw casing 52 by a hose clamp 114. A similar boot (not shown) may be incorporated into the spring loaded strut assembly 96 to cover the telescoping shaft plunger 100.

Figure 6:
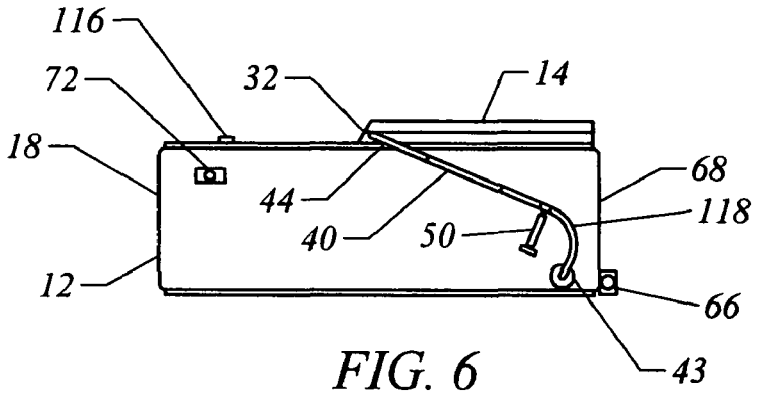
FIG. 6 is a side elevational view of the automated spa cover lift device at the mid-position of the lift process.
Figure 7:
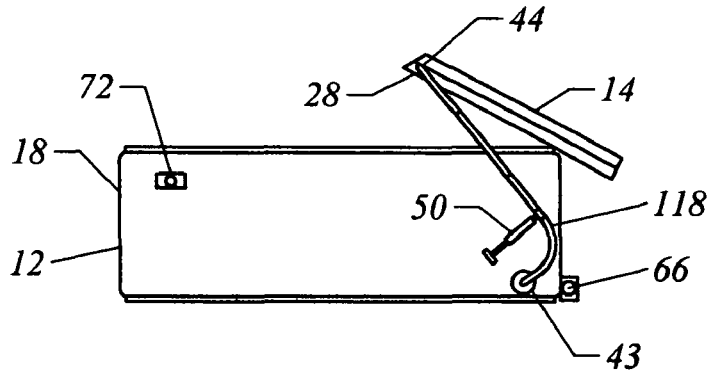
FIG. 7 is a side elevational view of the automated spa cover lift device at the final position of the lift process.
Figure 8:
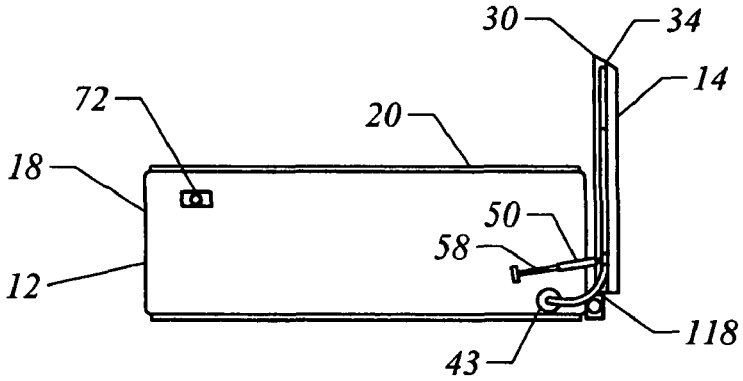

Operation of the automated lifting device is shown with reference to FIGS. 6-8. As shown in FIG. 6, the foldable spa cover 14 is first folded toward the back side 68. A pressure switch 116 on the top 20 of the spa 12 may be included as an override to the controller 72 to prevent operation of the motor until the cover is folded. As the folded cover 14 lifts, as shown in FIG. 7, the strut 50 and strut assembly (not visible) expand. Finally, when the folded cover 14 reaches its vertical position on the back 68 of the spa 12, the controller 72 stops the drive motor 66. The motor operates at 960 r.p.m. And the long screw shaft 58 takes approximately six or seven seconds to move the cover from one position to the other. As shown, it is preferred, but not required, that the side arm 40 have a pivotal mount on opposite sides of the spa 18 to provide a low profile to the folded and stored spa cover 14, and that the side arms 40 include a ninety degree bend 118, such that the side arms are in an out-of-the-way vertical position along each side of the stored cover 14 as shown in FIG. 8.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

The invention claimed is:

1. A spa cover lift device for foldable spa covers on a spa with a front, a back and opposite sides comprising:

an automated lift system in combination with a foldable spa cover having:

a pair of lift arms positionable on opposite sides of the spa wherein each arm has a first end pivotally connectable to the spa and a second end engageable with the foldable spa cover wherein, on pivot of the lift arms connected to the spa when the cover is folded, the folded cover is lifted from the spa to the back of the spa; and, a motorized actuator assembly connected to at least one of the lift arms and connectable to the spa whereon actuation of the motorized actuator assembly when the actuator assembly is connected to the spa, the lift arm is displaced for raising or lowering the folded cover, wherein the thermally efficient foldable spa cover has a top, a bottom, a width and a thickness and comprises:

a thick insulating cover piece in two half segments wherein the half segments of the cover piece are covered with a water-impervious casing and are interconnected by a hinge across the entire width of the cover that is constructed to pull the half segments together wherein the encased half segments each have a center edge that is inclined across the thickness forming a bevel wherein the inclined center edge of one half segment contacts and abuts the inclined center edge of the other half segment in a complimentary manner across the width of the cover by action of the hinge when the cover piece is lying flat with abutting inclined center edges oriented at an angle from the vertical wherein the space between the half segments is minimized or eliminated for thermal efficiency.

2. The spa cover lift device of claim 1 wherein the second ends of the pair of lift arms are connected to one of the half segments wherein the half segment has opposite side edges and the second ends of the lift arms are connected to opposite side edges of the half segment proximate the inclined center edge.

3. The spa cover lift device of claim 2 wherein one half segment of the cover piece has sockets in opposite side edges proximate the inclined center edge and the second ends of the lift arms have distal ends engageable in the sockets for connecting the lift arms to the half segment wherein at least the half segment with the sockets has a structural channel flush with the inclined center edge of the half segment.

4. A thermally efficient foldable spa cover having a width and a thickness for use on a spa comprising:

a thick insulating cover piece in two half segments wherein the half segments of the cover piece are covered with a water-impervious casing and are interconnected by a hinge across the width of the cover that is constructed to pull the half segments together wherein the encased half segments each have a center edge that is inclined across the thickness forming a bevel wherein the inclined center edge of one half segment contacts and abuts the inclined center edge of the other half segment in a complimentary manner across the width of the cover by action of the hinge when the cover piece is lying flat with abutting inclined center edges oriented at an angle from the vertical wherein the space between the half segments is minimized or eliminated for thermal efficiency.

5. The thermally efficient foldable spa cover of claim 4 wherein the cover piece when lying flat has a top and the hinge is formed at the top of the cover piece along the top of the inclined center edges.

6. The thermally efficient foldable spa cover of claim 5 wherein each half segment is covered by a casing and the hinge is formed by interconnecting the casings at the top of the inclined center edges.

7. The thermally efficient foldable spa cover of claim 6 wherein the casings of the half segments are interconnected by double stitching along the top of the incline center edges.

8. The thermally efficient foldable spa cover of claim 4 in combination with a spa cover lift device comprising a pair of lift arms positionable on opposite sides of a spa with first ends pivotally connected to one of the half segments wherein the half segment has opposite side edges and the second ends of the lift arms are connected to opposite side edges of the half segment proximate the inclined center edge.

9. The thermally efficient foldable spa cover and lift device of claim 8 wherein at least one of the lift arms has a motorized strut for pivoting the arm and raising the cover piece when the segments are folded.

* * * * *